United States Patent [19]

Schidlowski

[11] 3,980,178

[45] Sept. 14, 1976

[54] PROTECTIVE RECORD COVER

[76] Inventor: J. Carlos Schidlowski, P.O. Box 14, Sedalia, Colo. 80135

[22] Filed: July 26, 1974

[21] Appl. No.: 492,002

Related U.S. Application Data

[63] Continuation-in-part of Ser. No. 381,917, July 23, 1973, abandoned.

[52] U.S. Cl. ..... 206/313; 206/523; 220/339

[51] Int. Cl.[2] ..... B65D 81/02; B65D 85/02; B65D 85/30

[58] Field of Search ..... 206/310, 312, 311, 313, 206/309, 307, 403, 404, 521, 523; 229/68; 220/339

[56] References Cited

UNITED STATES PATENTS

| | | | |
|---|---|---|---|
| 2,691,440 | 10/1954 | Spugios et al. | 206/312 |
| 2,785,797 | 3/1957 | Rice | 206/310 |
| 2,807,359 | 9/1957 | McKierman | 229/68 R |
| 3,107,783 | 10/1963 | Corey et al. | 206/310 |
| 3,109,539 | 11/1963 | Turoff | 206/310 |
| 3,317,038 | 5/1967 | Bade et al. | 206/310 |
| 3,473,649 | 10/1969 | Posso | 206/404 |
| 3,552,551 | 1/1971 | Goldberg et al. | 206/403 |
| 3,612,233 | 10/1971 | Nagpal et al. | 206/403 |

*Primary Examiner*—William T. Dixson, Jr.

[57] ABSTRACT

A protective cover for phonograph records includes a pair of recessed, inwardly opening panels preferably composed of a plastic material hinged together along one edge, the panels forming when closed together a common recess therebetween which is sized to receive a phonograph record. A circular seating area is formed centrally of the recessed portion to prevent sliding movement of the record within the cover and a complementary rib and groove are formed just outwardly of the recessed portion to interengage with one another and to releasably lock the panels against misalignment. In one form of the invention, intersecting reinforcement ribs together with a foam liner may be employed to cover the reinforcement ribs and to cooperate with the rib members to retain the phonograph record within the cover in such a way that the recorded portion of the record is free from contact with the cover.

5 Claims, 9 Drawing Figures

PROTECTIVE RECORD COVER

This invention is a continuation in part application of Ser. No. 381,917 for PROTECTIVE RECORD COVER now abandoned and generally relates to enclosures or containers for phonograph records, memory disks and the like; and more particularly relates to a novel and improved protective record cover which is adapted to protect phonograph records for storage, shipping or mailing purposes.

Phonograph records are typically retained in paperboard jackets having a pocket in which the record is removably retained. Frequently, an inner sleeve of protective plastic or paper tightly surrounds the record and holds the record in position within the outer paperboard jacket. The record is, therefore, not adequately protected against rough handling which is frequently encountered in shipping or mailing so that it has become common practice when shipping or mailing phonograph records and the like to pack a plurality of the paperboard jackets in a more sturdy and protective outer container or box to prevent damage to the records.

Plastic record covers have been devised to better protect phonograph records and the like but these covers either do not provide adequately internal support for the record or are such that the recorded portions of the record are not adequately protected.

Accordingly, it is a primary object of the present invention to provide a new and improved plastic record cover adapted to protect records from external forces while supporting the record internally in a manner such that the recorded portion of the record is not damaged.

It is another object of the present invention to provide a record cover comprised of two inwardly opening recessed panels having a circular seating area in which a phonograph record is confined with raised supporting ribs engaging the record around the inner label-containing portion and the outer entry groove portion so as not to damage the recorded portion of the record.

It is a further object of the present invention to provide for a record cover preferably composed of plastic foam material which is extremely lightweight, compact and characterized by its ease and handling and substantial rigidity in the closed position.

It is another object of the present invention to provide a plastic record cover composed of inwardly opening recessed panels having foam linings defining seating areas for a phonograph record with supporting ribs projecting through the foam lining to support the record around the inner label-containing portion and the outer entry groove portion thereof.

It is still another object of the present invention to provide a protective record cover having a pair of inwardly opening recessed plastic panels with criss-crossing reinforcement ribs concealed in a Styrofoam lining with raised supporting ribs projecting through the lining into a recessed seat in the lining to support the record along unrecorded portions thereof.

These and other objects of the prevent invention are attained with a record cover which is designed to absorb external forces applied to the cover while uniquely supporting the record in a protected inner cavity whereby the record is not only adequately protected from external forces but is supported internally so as not to cause damage to the record. The record cover is composed of two recessed panels adapted to be hinged or otherwise secured together in facing relation to one another to define an inner cavity in which a phonograph record or the like is retained. The panels are provided with a cooperating rib and groove arrangement to releasably lock the panels together against misalignment and to assume that the recorded areas of the record are not damaged yet the record is protected from external forces applied to the cover.

In one embodiment described in detail hereinafter, the panels are composed of recessed outer plastic shells connected along one edge by a hinge and having a releasable latch along an opposite edge to releasably secure the panels in closed facing relationship. Each plastic shell has a plurality of criss-crossing reinforcement ribs for rigidity and concentric arcuate supporting ribs projecting above the level of the reinforcement ribs in locations to engage the central label-containing portion and the peripheral entry groove portion of the phonograph record so as to space the recorded portion of the record from the reinforcement ribs. A lining of Styrofoam or the like is incorporated into each outer shell so as to cover the reinforcement ribs and allow the supporting ribs to project therethrough. The Styrofoam lining is designed to define a peripheral annular shoulder to maintain the phonograph record in the desired position within the associated outer shell. In this manner, a phonograph record retained in the protective cover is enclosed by a rigidified outer shell designed to resist external forces applied to the cover and supported internally by ribbing which engages only unrecorded portions of the record to retain the record in spaced relation from a cushioning foam lining in the cover.

In another embodiment of the invention, extremely thin recessed outer plastic panels are again interconnected along one edge by a hinged portion and form when closed together a common recess therebetween which is sized to receive the record in a central seating area to properly center the record and in such a way that the record and panels are disposed in mutually reinforcing relation to one another. Outer cooperating annular ribs and grooves are disposed in surrounding relation to the recessed portion and to the record itself to releasably lock the panel members against misalignment whereby to greatly strengthen the resultant cover construction. This will prevent warpage of the record when stored therein.

It will, therefore, be appreciated that the protective cover of the present invention is not only wellsuited for temporary storage of phonograph record-type articles in the home, studio or the like, but is also suitable for mailing or shipping purposes without the need of a shipping box or other container. Furthermore, due to the rigidified characteristics of the outer shell of the cover, the article is protected from potential damage thereto caused by warpage, rough handling, dropping or the like.

Other objects, advantages and capabilities of the present invention will become more apparent as the description proceeds taken in conjunction with the accompanying drawings, in which.

Figure 1:
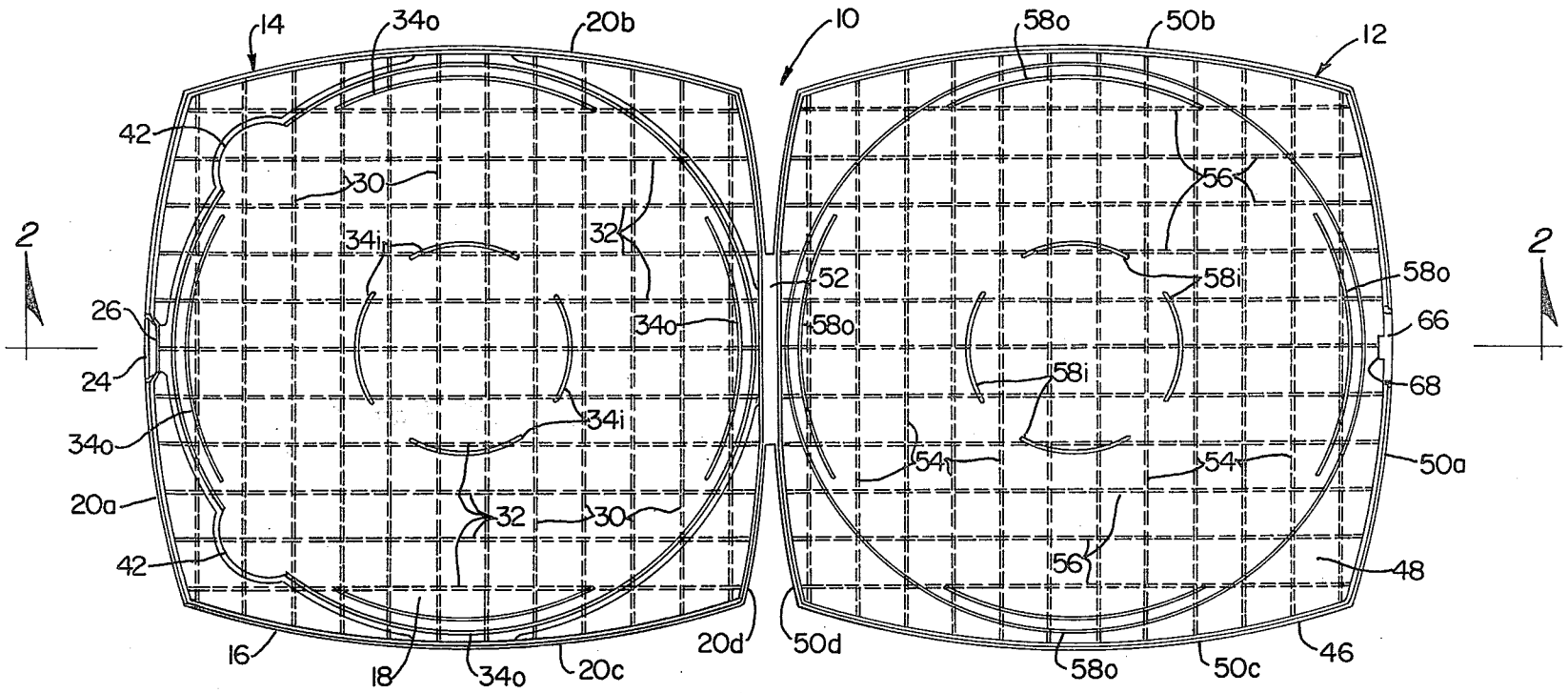
FIG. 1 is a top plan view of the protective record cover of the present invention in an open position.

Referring first to FIG. 1, the protective record cover 10 of the present invention is seen to include upper and lower panels 12 and 14 respectively of generally square configuration with outer convex sidewalls to be hereinafter described. The lower panel 14, as probably best seen in FIG. 2, includes a recessed outer shell 16 preferably of a rigid plastic material such as polypropylene. The lower shell 14 has a bottom wall 18 and four arcuate upturned side walls or flanges 20*a*, 20*b*, 20*c*, and 20*d* with the bottom wall 18 having a downwardly concave recessed portion 22 adjacent to the center of the front side wall 20*a* of the panel. The concave recessed portion 22 defines an upwardly and forwardly projecting arcuate segment 24 of the bottom wall 18. An arcuate upstanding rib 26 on the forwardly projecting segment 24 passes from the front side wall 20*a* on the opposite side of the segment to rigidify the segment since, as will be explained more fully hereinafter, the segment 24 of the bottom wall defines an attachment lip for a latch 28 which cooperates with a catch portion of the latch on the upper panel 12 to releasably secure the cover in the closed position shown in FIGS. 3 and 4.

The lower shell 16 is reinforced by a plurality of spaced parallel laterally extending reinforcement ribs 30 and spaced parallel longitudinally extending reinforcement ribs 32 which define a gridwork of intersecting or criss-crossing reinforcement for the lower shell. The reinforcement ribs 30 and 32 are bead-like and project upwardly from the bottom wall 18 of the lower panel to a height of approximately one-half the maximum depth of the lower panel.

Bead-like support ribs 34*i* and 34*o* also project upwardly from the bottom wall of the bottom panel to a height in excess of the height of the reinforcement ribs 30 and 32 but less than the overall depth of the lower panel 14. The support ribs are arranged in two concentric circular patterns, the first inner concentric pattern of support ribs 34*i* being located near the center of the lower panel and the second outer concentric pattern of support ribs 34*o* being located near the perimeter of the panel. The support ribs are arcuate in the configuration defining spaced arcs of concentric circles. The innermost support ribs 34*i* are arcs of a circle having a diameter slightly less than the diameter of conventional circular labels L presently affixed to phonograph records R to carry indicia relating to the material recorded on the record whereby a record placed in the recessed portion of the lower panel would be engaged around its label L by the innermost support ribs 34*i*. The outermost support ribs 34*o* define arcs of a circle having a diameter slightly less than the diameter of the phonograph record to be retained in the cover so as to engage the phonograph record along the conventional unrecorded entry groove EG at the periphery of the record. In this manner, a phonograph record seated in the lower panel 14 would rest on the supporting ribs 34*i* and 34*o* in a manner such that the recorded portion RP of the record between the label L and the entry groove EG would be elevated from the reinforcement ribs 30 and 32.

Figure 2:
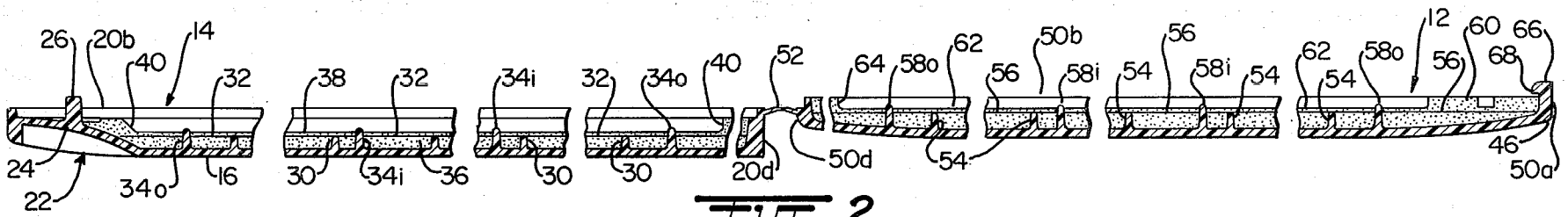
FIG. 2 is a vertical section taken along line 2—2 of FIG. 1.
Figure 3:
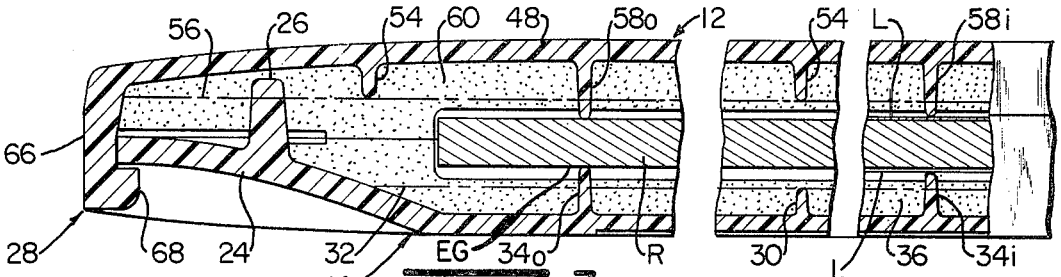
FIG. 3 is an enlarged fragmentary vertical section taken through the record cover in a closed position along the side thereof having the releasable latch.
Figure 4:
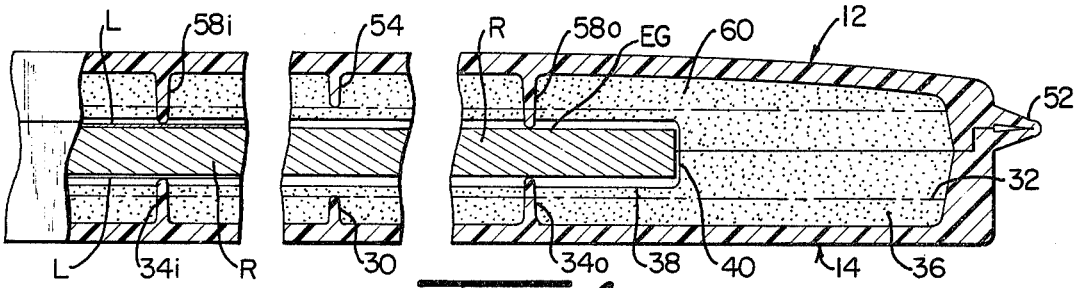
FIG. 4 is an enlarged fragmentary vertical section with parts removed taken through the record cover in the closed position along the side having the hinge thereon.
Figure 5:
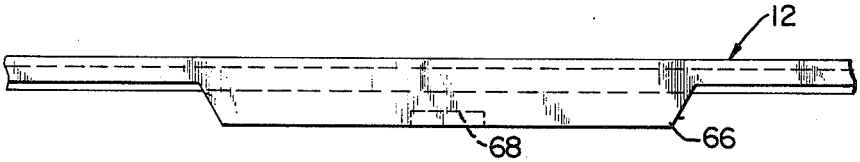
FIG. 5 is a fragmentary end elevation with parts removed for clarity showing one portion of the latch used on the protective cover of the present invention.
Figure 6:
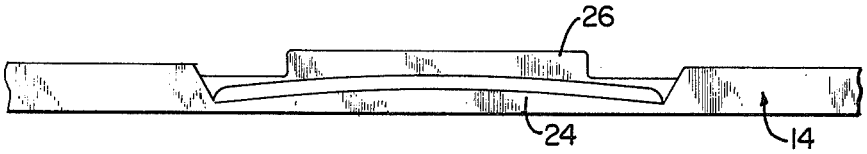
FIG. 6 is a fragmentary end elevation showing the portion of the latch used on the protective cover not shown in FIG. 5.

The lower shell 16 is provided with a foam lining 36 composed of a material, such as, Styrofoam or the like; and the foam lining as best seen in FIGS. 3 and 4, is of a depth so as to be flush with the upper edges of the side walls 20*a* through 20*d* of the lower panel 16. The lining 36 has a central circular recessed portion 38 conforming in size to that of a phonograph record R so as to define an annular shoulder 40 to prevent sliding movement of the phonograph record in the lower panel. The recessed portion 38 of the foam lining 36 is of a thickness sufficient to cover the reinforcement ribs 30 and 32 in the lower panel but such that both sets of support ribs 34*i* and 34*o* project upwardly therethrough whereby a phonograph record R seated in the lower panel (FIG. 2) would be elevated from the foam lining, particularly in the recorded portion RP of the record.

Spaced semi-circular finger openings 42 are formed in the foam lining 36 near the front side wall 20*a* of the lower panel 16 to facilitate removal of a record R seated in the recessed portion 38 of the lining. The finger openings 42 are of a depth equivalent to the depth of the recessed portion of the lining so that a record supported by the supporting ribs 34*i* and 34*o* can be removed by inserting one's finger into a semi-circular opening 42 in the lining and lifting the corresponding edge of the record out of the recess.

The upper panel 12 as shown in FIG. 2 also includes an outer recessed shell 46 of polypropylene or other rigid plastic material. The upper panel includes a top wall 48 with arcuate side walls 50*a*, 50*b*, 50*c* and 50*d* protruding away therefrom. The rear side wall 50*d* of the upper panel is connected to the rear side wall 20*d* of the lower panel by a living hinge 52 which forms a thin membrane-like integral connection between the panels at an intermediate location along the length of the rear side walls 20*d* and 50*d*. The upper panel 12 is a very similar to the lower panel 14 except that it is slightly shallower than the bottom panel. It includes a plurality of parallel spaced, transversely extending beadlike reinforcement ribs 54 and parallel spaced longitudinally extending bead-like reinforcement ribs 56 along the inner face of the top wall 48 which define a gridwork of intersecting or criss-crossing ribs to rigidify the upper panel. Inner and outer concentric, circular sets of arcuate bead-like support ribs 58*i* and 58*o* also project away from the inner face of the top wall 48 to define arcs of concentric circles which align with the support ribs 34*i* and 34*o* in the lower panel 14 when the upper and lower panels are disposed in overlying facing relationship. As with the inner set of support ribs 34*i* on the lower panel, the inner set of support ribs 58*i* on the upper panel are arcuate segments of a circle having a diameter slightly less than the diameter of the conventional label L affixed to the phonograph records R and the outer set of support ribs 58*o* are arcuate segments of a circle having a diameter slightly less than the diameter of the phonograph record so that the ribs 58*i* and 58*o* are adapted to engage the phonograph record around the centrally located label L and the entry groove portion EG of the record. The upper panel 12 is also provided with a foam lining 60 composed of a material such as Styrofoam or the like, which is of a depth so as to be flush with the upper edge of the side walls 50*a* through 50*d* of the panel around the perimeter of the panel and having a central circular recessed portion 62 conforming in size to that of the phonograph record R with an annular shoulder 64 adapted to prevent sliding movement of the record. The recessed portion 62 has a thickness sufficient to cover the reinforcement ribs 54 and 56 in the upper panel but is such that the supporting ribs 58*i* and 58*o* project therethrough for engagement with the phonograph record. The front side wall 50*a* of the upper panel 12 is enlarged at a central location 66 and has an inturned lip 68 defining a catch which is adapted to snap over the segment 24 of the lower panel 14 to releasably secure the upper and lower panels in overlying closed abutting relationship.

It will be appreciated that when the panels are disposed in overlying abutting relationship, the recessed portions of the foam linings establish a closed circular disk-like cavity conforming in size to that of the phonograph record. In this manner, the phonograph record can be positively retained in the cavity by the supporting ribs engaging opposite surfaces of the record around the label thereon and along the entry groove portion thereof so that the record is clamped between the panels with the recorded portion of the record held in spaced relation from the inner foam lining of each panel.

Figure 7:
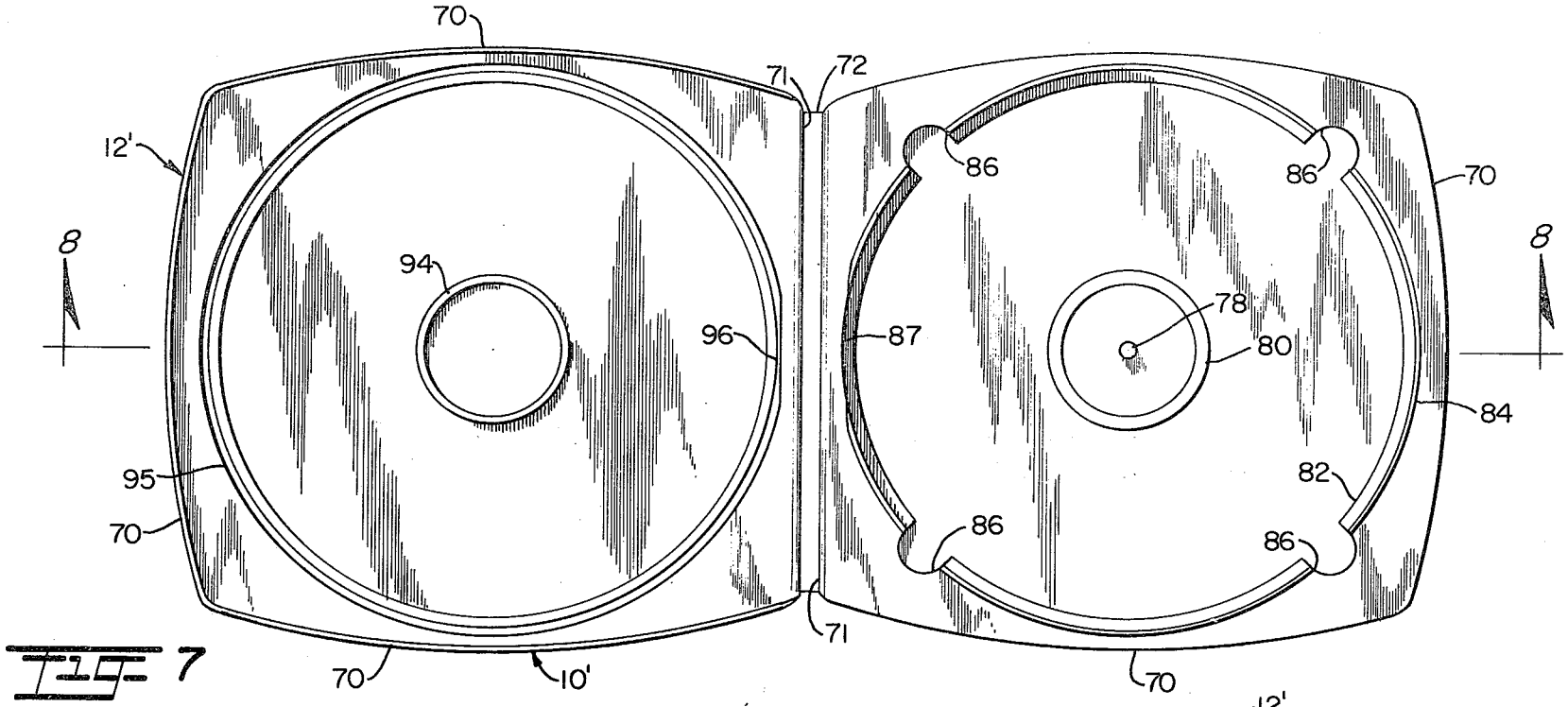
FIG. 7 is a plan view of another form of protective record cover in accordance with the present invention illustrated in the open position.
Figure 9:
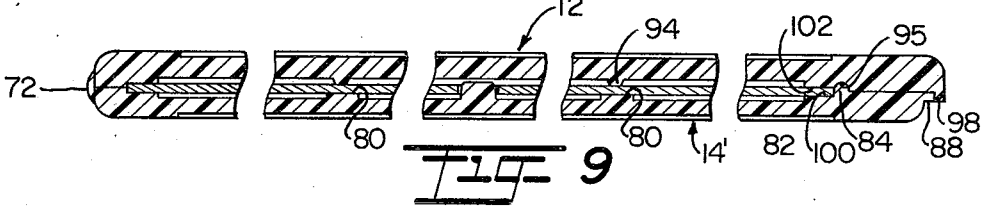
FIG. 9 is an enlarged, fragmentary cross-sectional view taken through the protective cover in its closed position.
Figure 8:
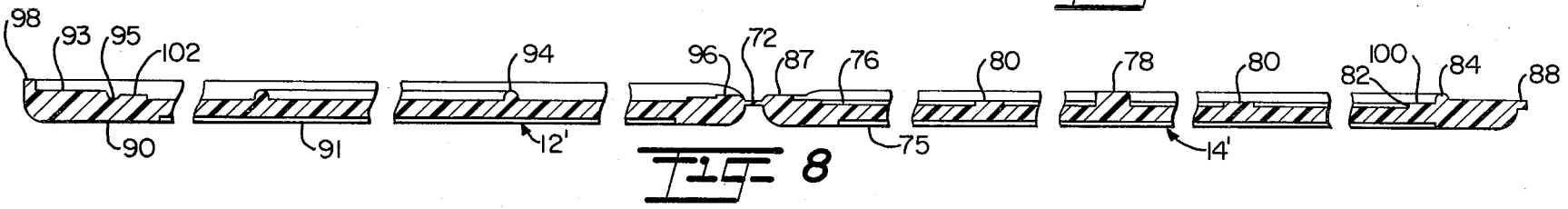
FIG. 8 is a sectional view taken about lines 8—8 of FIG. 7.

In the embodiment shown in FIGS. 7 to 9, the record cover 10′ is comprised of upper and lower panels or cover member 12′ and 14′, respectively, which are correspondingly of a square configuration and of corresponding size, each having outer convex side edges 70 along three sides and a straight edge 71 interconnected by a living hinge 72 which forms a unitary connection between the adjoining edges 71 similar to the hinge 52 shown in FIGS. 1 and 2.

The lower panel 14′ has a bottom wall 74 of substantially uniform thickness including a circular depressed portion 75 in its outer surface and a shallow annular recessed portion 76 formed in its inner surface between an outer peripheral portion 77 of increased thickness with respect to the bottom wall 74 and a central upstanding projection 78. The recessed portion 76 is also interrupted by a shallow circular rib 80 corresponding to the depth of the recessed portion 76. An outer shoulder 82 is formed by the outer edge of the recessed portion and an upstanding circular rib 84 projects upwardly from the bottom wall 74, the rib 84 circumscribing the entire recessed portion 76, except where it is interrupted by finger openings 86 at four equally spaced circumferential intervals and flat surface portion 87 along a limited length of the inner part of the panel 14′ nearest to the hinge 72.

The outer peripheral portion 77 of the panel 14′ terminates in radially outwardly extending lips or ridges 88 along the convex side edges 70 for a purpose to be described.

The upper panel 12′ is defined by a flat upper wall 90 corresponding in thickness to the bottom wall 74 and of substantially uniform thickness including a circular depressed portion 91 in its outer surface and a shallow annular recessed portion 92 in its inner surface within an outer peripheral portion 93 of increased thickness with respect to the wall 90. A centrally located circular rib 94 projects upwardly from the lower surface of the recessed portion and is dimensioned to define a central seating area which will contact the inner or label portion L of a record R. The outer peripheral portion 93 is provided with a shallow, circular groove 95 complementary to the rib 80 but which extends continuously around the inner surface of the peripheral portion 93 except for a limited flat surface portion 96 corresponding in length and aligned with the flat surface portion 87. The outer peripheral portion 93 terminates in upturned portions or forwardly directed flanges 98 along the three side edges 70 of the upper panel and so located as to snugly overlap the ridges 88 of the lower panel 14′ in the closed position as shown in FIG. 9.

When a record R is placed within the recessed portion 76 of the lower panel 14′ it is accurately centered thereon by insertion of the pin or projection 78 through the central opening of the record; and as stated, the inner rib 80 will contact the label portion L of the record. The upper panel 12′ is closed over the lower panel 14′ with the outer flanges 98 pressfit over the ridges 88 and the circular rib portions 84 entered into the complementary groove 95. It will be evident that the aligned flat surface portions 96 and 87 avoid the necessity of aligning the complementary rib and groove portions adjacent to the adjoining edges 71 where the panels would first contact one another and be more difficult to properly mate the rib and groove portions. In this relation, the rib portions 84 are sufficiently rigid to fit snugly within the groove 95 so as to releasably interlock the panels and to effectively seal the record within the common recessed area formed by the recessed portions 76 and 92. Again, in a manner similar to that described with reference to FIGS. 1 to 6, the rib 94 is aligned opposite to the rib 80 in order to yieldingly contact opposite surfaces of the record R while retaining the recorded portion RP of the record R away from contact with the recessed surface portions of the panels 12′ and 14′.

It will be appreciated that the record cover of the present invention will reliably protect a phonograph record retained therein since the outer shell for the cover is of a semi-rigid or hard plastic material which will resist most external forces applied to the cover. Moreover, by suspending the record within the internal cavity of the cover such that the recorded portion of the record is spaced from the cover, the record is also protected internally. Furthermore, in the first form described, the foam lining in the protective cover serves to cushion the record from any inward flexing of the outer shell which may be caused by excessive external forces applied to the cover.

In the alternate form of invention shown in FIGS. 7 to 9, it will be apparent that the record may be accurately centered within the recessed portion without the aid of the center spindle 78 and one or both of the circular ribs 80 and 94 and seating the record within the recessed portion 76 or 92 prior to closing the panel members together. Of course, elimination of one or both ribs 80 and 94 would permit the recorded portion of the record to be contacted by the flat surface areas on opposite sides of the recessed portions but would also permit full insertion of the arcuate rib portions 84 into the complementary groove 95 so as to more firmly lock the panel members against shifting or displacement. In this relation, when the inner circular ribs 80 and 94 are employed, they are most desirably composed of a material which has sufficient compressibility or flexibility to be compressed somewhat by the record R when the record is sandwiched between panel members so that the record will be seated within the recessed area 76 and the rib portions 84 will be firmly seated within the complementary groove 95.

The resultant cover construction can be constructed of extremely thin panels requiring a minimum amount of materials. Most desirably, the panels are composed of rigid or semi-rigid plastic materials such as but not limited to a PVC or polypropylene material.

Although the present invention has been described with a certain degree of particularlity, it is understood that the present disclosure has been made by way of example and that changes in details of structure may be made without departing from the spirit thereof.

What is claimed is:

1. A record cover for a circular phonograph record having a central circular label area, an unrecorded circular peripheral area, and a recorded area between the label area and the unrecorded area comprising in combination first and second plastic panels of generally square configuration, each panel having a broad but shallow recessed inner face, a plurality of mutually perpendicular reinforcement ribs forming a rib gridwork in the recessed inner face of each panel to rigidity the panels, a first set of spaced elongated bead-like arcuate support ribs in the recess of each panel defining arcs of a common circle having a diameter slightly less than the diameter of the label of the phonograph record, a second set of spaced elongated bead-like arcuate support ribs in the recess of each panel defining arcs of a common circle concentric with and larger than said first-mentioned common circle, the diameter of the second-mentioned common circle being the same as at least a portion of the circular unrecorded peripheral area of the record, said support ribs extending away from the recess of each panel slightly more than said reinforcement ribs, a Styrofoam lining in the recess of each panel, said linings each having a circular recessed portion conforming in size to the phonograph record so as to seat the phonograph record and defining an annular shoulder adapted to prevent the phonograph record from sliding in the recessed portion, said recessed portion of the lining covering the reinforcement ribs and the supporting ribs protruding through the lining so as to support the phonograph record within the recessed portion of the lining in spaced relation from the lining, a living hinge pivotally interconnecting corresponding sides of the panels whereby the panels are pivotal between an open and closed position, said inner faces of the panels being in face-to-face relationship in the closed position so that said recesses in the lining define a closed cavity for the phonograph record, and cooperating latch members on corresponding sides of the panels, said latch members being on sides opposite to the sides which are pivotally connected.

2. A record cover for a circular phonograph record having a central circular label area, an unrecorded circular peripheral area, and a recorded area between the label area and the unrecorded area comprising in combination, first and second plastic panels, each panel having a broad but shallow recessed innerface, a first set of spaced elongated bead-like arcuate support ribs in the recess of each panel defining arcs of a common circle having a diameter slightly less than the diameter of the label of the phonograph record, and a second set of spaced elongated bead-like arcuate support ribs in the recess of each panel defining arcs of a common circle concentric with and larger than said first mentioned common circle, the diameter of the second mentioned common circle being the same as at least a portion of the circle unrecorded peripheral area of the record, said inner faces of the panels being adapted to be placed in face-to-face relationship so that said recesses in the panels define a closed cavity for the phonograph record.

3. The record cover of claim 2 further including reinforcing ribs protruding away from the inner face of each panel to rigidify the panel, said supporting rib means extending a greater distance away from said inner faces than said reinforcing ribs.

4. The record cover of claim 3 wherein said reinforcing ribs define an innersecting pattern of ribs in mutually reinforcing relation to one another.

5. The record cover of claim 4 further including a foam lining in the recess of each panel and wherein said reinforcing ribs are covered by the foam lining and said supporting rib means protrude through the foam lining to retain a record in spaced relation from the foam lining.

* * * * *